US008506420B2

(12) United States Patent
Hocknell et al.

(10) Patent No.: US 8,506,420 B2
(45) Date of Patent: Aug. 13, 2013

(54) GOLF CLUB HEAD WITH GROOVES

(75) Inventors: Alan Hocknell, Carlsbad, CA (US); Matthew T. Cackett, San Diego, AZ (US)

(73) Assignee: Callaway Golf Company, Carlsbad, CA (US)

( * ) Notice: Subject to any disclaimer, the term of this patent is extended or adjusted under 35 U.S.C. 154(b) by 210 days.

(21) Appl. No.: 13/087,091

(22) Filed: Apr. 14, 2011

(65) Prior Publication Data

US 2011/0256956 A1 Oct. 20, 2011

Related U.S. Application Data

(60) Provisional application No. 61/325,161, filed on Apr. 16, 2010.

(51) Int. Cl.
*A63B 53/04* (2006.01)

(52) U.S. Cl.
USPC ..... 473/331; 473/349; 473/350

(58) Field of Classification Search
USPC ..... 473/330–331, 349, 350, 287–292
See application file for complete search history.

(56) References Cited

U.S. PATENT DOCUMENTS

| | | | | | |
|---|---|---|---|---|---|
| D55,278 | S | * | 5/1920 | Kraeuter | D21/750 |
| 2,005,401 | A | * | 6/1935 | Storz | 473/331 |
| D193,098 | S | * | 6/1962 | Davis | D21/750 |
| D210,033 | S | * | 1/1968 | Johnston | D21/750 |
| 4,027,885 | A | | 6/1977 | Rogers | |
| 4,077,632 | A | | 3/1978 | Taylor | |
| 4,529,203 | A | | 7/1985 | Ribaudo | |
| 4,768,787 | A | | 9/1988 | Shira | |
| 5,082,278 | A | * | 1/1992 | Hsien | 473/242 |
| 5,354,059 | A | * | 10/1994 | Stuff | 473/329 |
| 5,437,088 | A | * | 8/1995 | Igarashi | 29/527.6 |
| 5,785,610 | A | * | 7/1998 | Birmingham | 473/331 |
| 6,048,277 | A | * | 4/2000 | Raymond | 473/331 |
| 6,193,615 | B1 | | 2/2001 | Hirota | |
| 6,257,994 | B1 | * | 7/2001 | Antonious | 473/331 |
| 6,309,310 | B1 | * | 10/2001 | Shira | 473/331 |
| 7,179,175 | B2 | | 2/2007 | Kennedy, III | |
| 7,452,283 | B2 | | 11/2008 | Hettinger et al. | |
| 7,473,187 | B2 | | 1/2009 | Vokey et al. | |
| 7,585,232 | B2 | * | 9/2009 | Krumme | 473/329 |
| 7,594,862 | B2 | * | 9/2009 | Gilbert | 473/330 |
| 7,594,863 | B2 | * | 9/2009 | Ban | 473/331 |
| 7,674,188 | B2 | * | 3/2010 | Ban | 473/330 |
| 7,677,990 | B2 | * | 3/2010 | Ban | 473/331 |
| 7,758,449 | B2 | * | 7/2010 | Gilbert et al. | 473/330 |
| 7,815,521 | B2 | * | 10/2010 | Ban et al. | 473/330 |
| 7,878,923 | B2 | * | 2/2011 | Yamagishi et al. | 473/330 |
| 7,909,708 | B2 | * | 3/2011 | Gilbert | 473/330 |
| 7,918,747 | B2 | * | 4/2011 | Johnson et al. | 473/328 |
| 2003/0220157 | A1 | * | 11/2003 | Dennis et al. | 473/342 |
| 2004/0038745 | A1 | * | 2/2004 | Ahlqvist | 473/331 |
| 2009/0247318 | A1 | | 10/2009 | Ban et al. | |
| 2009/0264217 | A1 | | 10/2009 | Johnson et al. | |

* cited by examiner

*Primary Examiner* — Sebastiano Passaniti
(74) *Attorney, Agent, or Firm* — Michael A. Catania; Rebecca Hanovice; Sonia Lari

(57) ABSTRACT

The present invention discloses a golf club head having a plurality of grooves. On the face of the golf club head is a first and second plurality of grooves. The second set of plurality of grooves is smaller in width and depth than those of the first set of plurality of grooves. Each groove of the second set of grooves is positioned at an angle ranging from 15 degrees to 25 degrees relative to each groove of the first set of grooves.

15 Claims, 3 Drawing Sheets

GOLF CLUB HEAD WITH GROOVES

CROSS REFERENCES TO RELATED APPLICATIONS

The Present Application claims priority to U.S. Provisional Application No. 61/325,161 filed on Apr. 16, 2010, which is hereby incorporated by reference in its entirety.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head. More specifically, the present invention relates to a golf club head having a plurality of grooves.

2. Description of the Related Art

The prior art discloses various methods to manufacture golf club heads, especially iron-type golf club heads. For example, Rogers, U.S. Pat. No. 4,027,885 for Golf Iron Manufacture, discloses scoring grooves into a face for the club head.

Taylor, U.S. Pat. No. 4,077,632 for a Lined Face For A Golf Club discloses grooves in compliance with the Rules of Golf at that time.

Ribaudo, U.S. Pat. No. 4,529,203, for Golf Club discloses a golf club face having grooves to eliminate the slice or the hook of the golf ball.

Shira, U.S. Pat. No. 4,768,787, for a Golf Club Including High Friction Striking Face discloses grit blasting the horizontal grooves to provide a friction generating surface when the striking surface of the golf club head engages a ball. The metallic matrix of the golf ball striking face contains hard particles which are harder than the metallic matrix and protrude above the surface.

Stuff, U.S. Pat. No. 5,354,059, for Golf Club Heads With Means For Imparting Corrective Action, discloses a club head with at least two non-parallel sets of grooves.

Doolen, U.S. Pat. No. 6,179,725, for a Golf Club Having Angular Grooves discloses grooves oriented at various angles. The plurality of grooves across the golf club face are angled at an angle that is substantially non-parallel with the club sole. All grooves however are sloped in the same direction as one another.

Hirota, U.S. Pat. No. 6,193,615, for a Head Of Golf Clubs That Spins More, discloses a face having grooves that allow for pressure to act specially on the edges of the grooves to increase ball spin.

Vokey et al, U.S. Pat. No. 7,473,187, for Spin Milled Grooves For A Golf Club, discloses machining grooves into a face.

Hettinger et al., U.S. Pat. No. 7,452,283, for a Putterhead With Dual Milled Face Pattern, discloses milling grooves into a face of a putter.

Kennedy, III, U.S. Pat. No. 7,179,175, for a Golf Club Having Stepped Grooves, discloses a golf club head with V-shaped and U-shaped grooves.

U.S. Patent Application Publication Number 2009/0264217 to Johnson et al., for Golf Club Head Having a Grooved Face, discloses a spin milling or fly cutting method for forming grooves. This manner allows for tighter draft angles, increases the rate of production, and allows for tighter tolerances than casting or forging.

U.S. Patent Application Publication Number 2009/0247318 to Ban et al., for Golf Club Head, discloses a plurality of striations formed on the face and extending from a toe side to a heel side, where the cross sectional shape of each striation is a triangle asymmetric with regard to the a virtual center line in a width direction and the smallest interior angle of the three interior angles of the triangle being placed at the sole side of the golf club head.

Although these inventions have provided novel methods for forming grooves on the face of the golf club head, the prior art has not optimized groove formation.

Scoreline designs generally have a cross-section geometry that includes two edges, two side walls and a bottom. The side walls are at a predetermined angle from a vertical line. Usually, each wall has more than one section and those sections are straight or curved. Alternatively, the scoreline design is a "V" shape, in which case there is no bottom other than a vertex or fillet radius.

Iron-type golf clubs having scorelines with sharp edges and relatively vertical side walls are advantageous to golfers since such sharp edged grooves allow golfers to induce higher levels of spin on a ball struck with such an iron-type golf club having sharp edged grooves. Iron-type golf clubs without sharp edged grooves or essentially vertical side walls will induce less spin when impacting a golf ball, especially higher-lofted (40 degrees +) golf clubs.

The following requirements apply to apply to the collective ser of grooves on any individual club head. Groove width (W) is measured per the USGA 30° method. Less than 50% of groove widths shall be greater than 0.035 inch and no single groove width shall be greater than 0.037 inch. Groove widths shall not vary by more than 0.010 inch from narrowest to widest. Groove depth (D) is measured per the USGA method from adjoining land areas. Less than 50% of groove depths shall be greater than 0.020 inch and no single groove depths shall be greater than 0.022 inch. Groove depths shall not vary by more than 0.010 inch from shallowest to deepest. Groove spacing (S) is measured per the USGA 30° method. Less than 50% of groove spaces shall be less than 0.075 inch or be less than three times the width of the widest amount adjacent groove. No single groove space shall be less than 0.073 inch or be less than three times the width of the widest adjacent groove minus 0.008 inch.

For heads other than drivers and putters, the area/pitch "A/P" is measured per the USGA method from adjoining land areas. Less than 50% of A/P values shall be greater than 0.0030 inch and no single A/P value shall be greater than 0.0032 inch. For heads having loft equal or greater than 25°, the effective radius "ER" is measured per the USGA 0.0110 inch R circle method. Less than 50% of the grooves shall have more than 10° of effective radius greater than 0.0110 inch and no single groove shall have any amount of effective radius greater than 0.0113 inch.

Backspin is the primary mechanism by which a golfer can control a golf ball upon landing after being struck. Backspin is especially important for short shots where proximity to the hole is of greater consequence to the golfer. High lofted clubs (50 degrees to 75 degrees) have grooves designs which are meant to interact with the surface of a golf ball at impact and remove debris from the contacting surface in order to increase friction and thereby impart more spin on the ball. Unlike intermediate lofts whose spin can either be increased or decreased with increased friction, the high lofted club will almost always increase spin through increased friction. Traditionally groove designs have focused on increasing the groove area underneath the golf ball at impact.

BRIEF SUMMARY OF THE INVENTION

The present invention provides a novel solution to imparting backspin by using high lofted golf clubs. The present invention increases the number of sharp edges that contact a golf ball during impact in order to increase the backspin. The sharp edges slice through debris and "grab" a soft cover of a golf ball better than grooves that have fewer edges. This leads to higher effective coefficients of friction for the golf club which in turn leads to more backspin.

For high lofted clubs, the sliding between the golf ball and the face of the golf club occurs during the majority of time of the impact between the golf ball and the face. Due to this sliding time period of the impact time, the backspin of a golf ball is increased by increasing the effective coefficient of friction between the two surfaces, the golf ball and the face of the golf club.

The effective coefficient of friction between the two surfaces, the golf ball and the face of the golf club, is primarily a function of the number of edges that the golf ball contacts and the sharpness of the edges. The impact also results in a finite area of contact between the golf ball and the face of the golf club. The area of contact is generally circular in shape. Due to the finite area of contact, there is a design of grooves that will maximize the length of edges that contact the ball during impact. The present invention maximizes the number of grooves in contact with a golf ball during an impact.

One aspect of the present invention is an iron-type golf club head with a body having a face. On the face is a first and second plurality of grooves. Each of the first plurality of grooves has a depth of at least 0.010 inch and each of the first plurality of grooves is spaced at least 0.1 inch from any other of the first plurality of grooves. Each of the second plurality of grooves has a depth of less than 0.0008 inch.

Another aspect of the present invention is an iron-type golf club head with a body having a face. A first plurality of grooves is located on the face. Each of the first plurality of grooves has a depth of at least 0.010 inch and each of the first plurality of grooves is spaced at least 0.02 inch from any other of the first plurality of grooves. Additionally, a second plurality of grooves is located on the face. Each of the second plurality of grooves has a depth of 0.0008 inch and each of the second plurality of grooves is spaced from 0.010 inch to 0.015 inch from an adjacent groove of the second plurality of grooves.

Further, each grooved of the second plurality of grooves is positioned between each groove of the first plurality of grooves and is positioned such that it has an angle ranging from 15 degrees to 25 degrees relative to each groove of the first plurality of grooves.

Yet another aspect of the present invention is a body having a face and a first plurality of grooves located on the face. Each of the first plurality of grooves has a depth of at least 0.010 inch and each of the first plurality of grooves is spaced at least 0.02 inch from any other of the first plurality of grooves. A plurality of second set of grooves is also located on the face, each of the plurality of second set of grooves having six microgrooves with a depth of approximately 0.0008 inch and spaced preferably between 0.010 and 0.015 inch from an adjacent microgroove. Each second set of grooves of the plurality of second set of grooves is positioned between each of the first plurality of grooves. Further, each of the grooves of the second set of grooves are positioned at an angle ranging from 15 degrees to 25 degrees relative to each groove of the first plurality of grooves.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
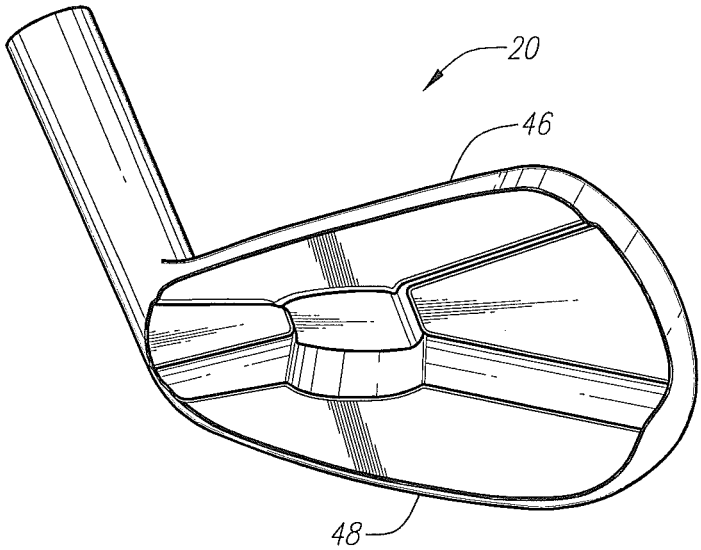
FIG. 1 is a perspective view of an iron-type golf club head.
Figure 2:
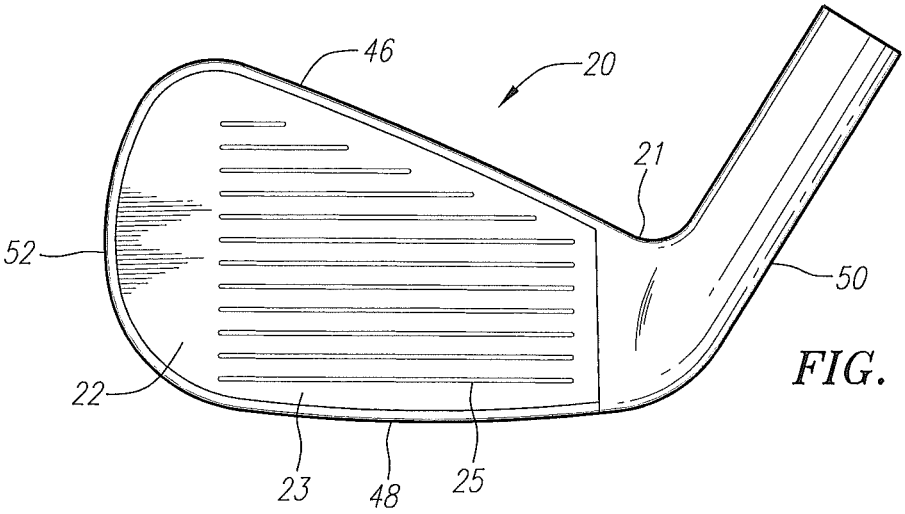
FIG. 2 is a front view of an iron-type golf club head.
Figure 3:
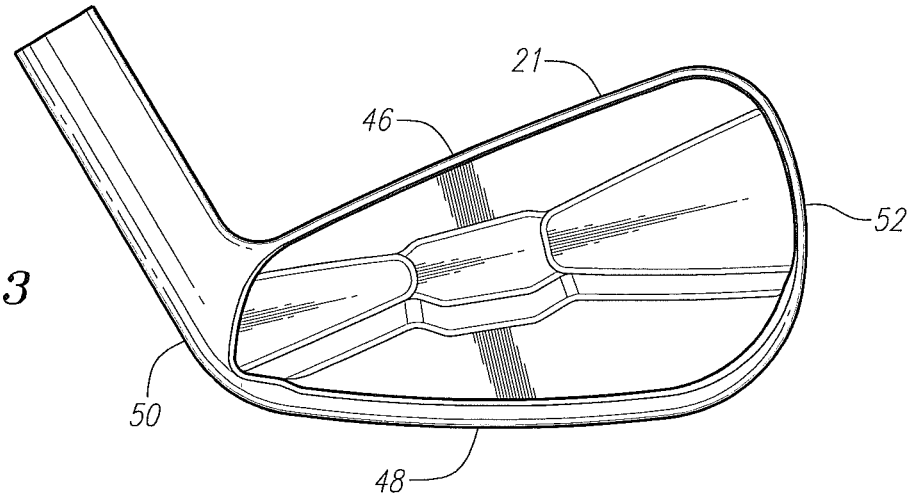
FIG. 3 is a rear view of an iron-type golf club head.
Figure 4:
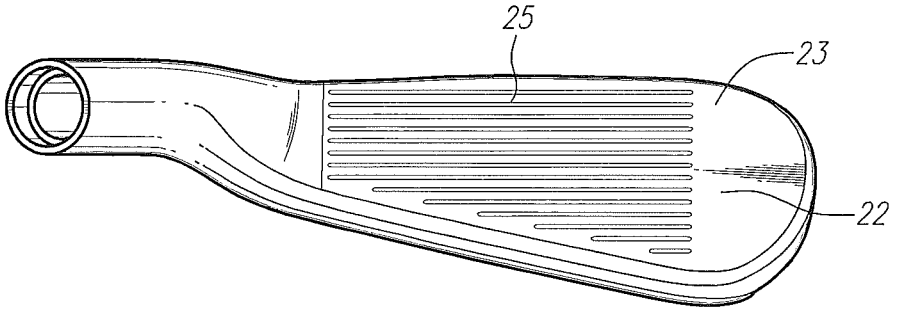
FIG. 4 is a top plan view of an iron-type golf club head.
Figure 5:
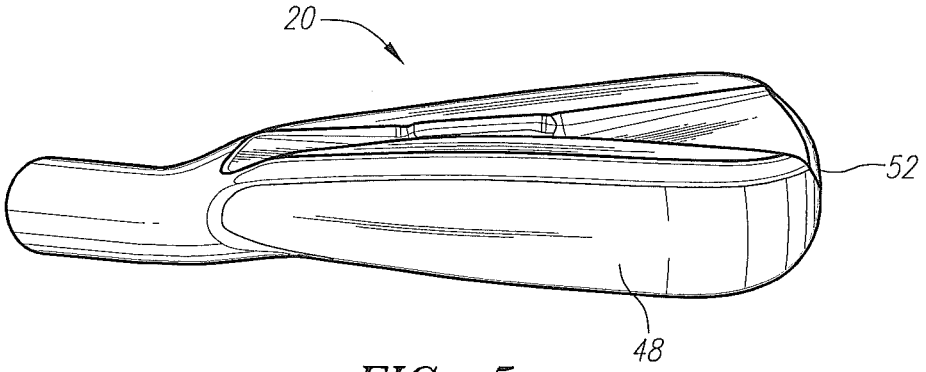
FIG. 5 is a bottom plan view of an iron-type golf club head.
Figure 6:
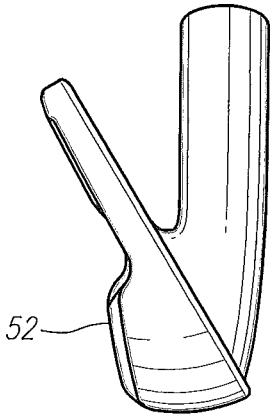
FIG. 6 is a toe side view of an iron-type golf club head.
Figure 7:
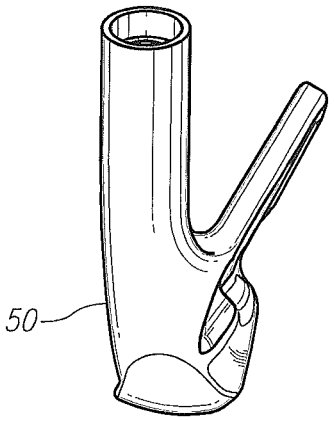
FIG. 7 is heel side view of an iron-type golf club head.
Figure 8:
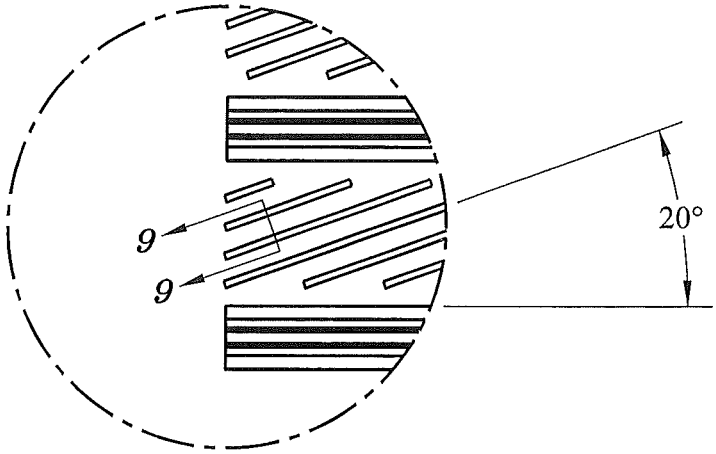
FIG. 8 is an isolated and enlarged view of the first and second set of plurality of grooves.

As shown in FIG. 1-8, an iron-type golf club is generally designated 20. The golf club head 20 also has a top portion 46, a sole portion 48, a heel portion 50, a toe portion 52 and a rear surface 54. The top wall 46 extends rearward from the top end of the front surface 23. The golf club head 20 includes a body 21 having a face 22 with a surface 23 and a plurality of grooves 25. The body 21 is preferably composed of a material such as titanium materials, stainless steel, carpenter steel, 1020 steel, amorphous metals and the like. The material of the body 21 preferably has a density between 4 g/cm$^3$ and 10 g/cm$^3$. Such titanium materials include pure titanium and titanium alloys such as 6-4 titanium alloy, 6-22-22 titanium alloy, 4-2 titanium alloy, SP-700 titanium alloy (available from Nippon Steel of Tokyo, Japan), DAT 55G titanium alloy available from Diado Steel of Tokyo, Japan, Ti 10-2-3 Beta-C titanium alloy available from RTI International Metals of Ohio, and the like. The body 21 is preferably manufactured through casting. Alternatively, the body 21 is manufactured through forging, forming, machining, powdered metal forming, metal-injection-molding, electro-chemical milling, and the like.

A groove 25 of the first set of plurality of grooves has a width, W1, preferably ranging from 0.024 inch to 0.030 inch. The width is defined as the distance across a groove 25 from an inflection point of one end to an inflection point of the opposing end. A groove of the first set of plurality of grooves has a depth (D1) of at least 0.010 inch. A distance between grooves 25 is the spacing (S1) and each of the first plurality of grooves is spaced at least 0.1 inch from any other of the first plurality of grooves and is preferably between 0.075 inch and 0.11 inch.

Figure 9:
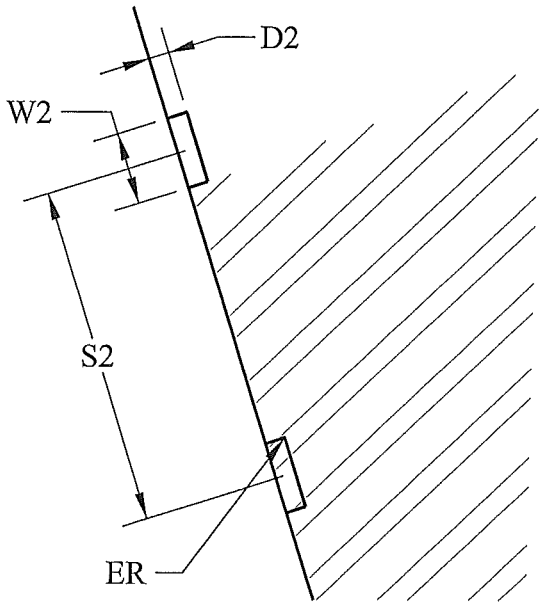
FIG. 9 is an isolated and enlarged cross-sectional view of FIG. 8 showing the groove of the second set of plurality of grooves on a face of an iron-type golf club head.

As shown in FIG. 9, each of the grooves 25 of the second set of plurality of grooves has a depth (D2) of approximately 0.008 inch. A groove 25 of the second set of plurality of grooves has a width, W2, preferably ranging from 0.002 inch to 0.003 inch. Further, as shown in FIG. 9 a distance (S2) between each of the second plurality of grooves is spaced ranging from 0.010 to 0.015 inch from an adjacent groove of the second plurality of grooves.

Additionally, each of the second plurality of grooves may have a V-like cross-sectional shape, square cross-sectional shape, or U-like cross-sectional shape.

As shown in FIG. 9, the effective radius of a groove (25) is shown. The effective radius ("ER") is preferably 0.0015 inch.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. An iron-type golf club head comprising:

a body having a face; and a first plurality of grooves located on the face, wherein each of the first plurality of grooves has a depth of at least 0.010 inch and each of the first plurality of grooves is spaced at least 0.1 inch from any other of the first plurality of grooves; and a second plurality of grooves, wherein each of the second plurality of grooves has a depth of approximately 0.0008 inch, and each of the second plurality of grooves is positioned at an angle ranging from 15 degrees to 25 degrees relative to each of the first plurality of grooves, wherein each of the second plurality of grooves has a width ranging from 0.0025 inch to 0.0030 inch;

wherein each of the second plurality of grooves is positioned between and spaced apart from adjacent grooves of the first plurality of grooves, wherein each of the second plurality of grooves has a spacing ranging from 0.010 inch to 0.015 inch.

2. The iron-type golf club head according to claim 1 wherein the body is composed of stainless steel, titanium alloy, carpenter steel, or any combination thereof.

3. An iron-type golf club head comprising:

a body having a face; and a first plurality of grooves located on the face, wherein each of the first plurality of grooves has a depth of at least 0.010 inch and each of the first plurality of grooves is spaced at least 0.02 inch from any other of the first plurality of grooves; and a second plurality of grooves, each of the second plurality of grooves has a spacing ranging from 0.010 inch to 0.015 inch from an adjacent second plurality of grooves, wherein each of the second plurality of grooves is positioned at an angle ranging from 15 degrees to 25 degrees relative to the first plurality of grooves, wherein each of the second plurality of grooves has a width ranging from 0.0025 inch to 0.0030 inch;

wherein each of the second plurality of grooves is positioned between and spaced apart from adjacent grooves of the first plurality of grooves.

4. The iron-type golf club head according to claim 3 wherein the body is composed of stainless steel, titanium alloy, carpenter steel, or any combination thereof.

5. The iron-type golf club head according to claim 3 wherein the golf club head has a loft angle ranging from 50 degrees to 68 degrees.

6. An iron-type golf club head comprising:

a body having a face; and a first plurality of grooves located on the face, wherein each of the first plurality of grooves has a depth of at least 0.010 inch and each of the first plurality of grooves is spaced at least 0.02 inch from any other of the first plurality of grooves; and a plurality of microgrooves, each of the plurality of microgrooves is spaced no more than 0.015 inch from an adjacent microgroove, wherein each microgroove of the plurality of microgrooves is positioned between and spaced apart from each of the first plurality of grooves and each microgroove of the plurality of micro grooves is positioned at an angle ranging from 15 degrees to 25 degrees relative to each first set of grooves of the plurality of first set of grooves, wherein each of the microgrooves has a width ranging from 0.0025 inch to 0.0030 inch.

7. The iron-type golf club head according to claim 6 wherein the body is composed of stainless steel, titanium alloy, carpenter steel, or any combination thereof.

8. An iron-type golf club head comprising:

a body having a face; and a first plurality of grooves located on the face, wherein each of the first plurality of grooves has a depth of at least 0.010 inch and each of the first plurality of grooves is spaced at least 0.02 inch from any other of the first plurality of grooves, wherein the number of first plurality of grooves ranges from 12 to 18; and a plurality of microgrooves, each of the plurality of microgrooves is spaced 0.010 inch to 0.015 inch from an adjacent microgroove, wherein each microgroove of the plurality microgrooves is positioned between and spaced apart from each of the first plurality of grooves wherein the number of microgrooves ranges from 60 to 90, wherein each microgroove is positioned at an angle ranging from 15 degrees to 25 degrees relative to the first plurality of grooves, wherein each of the microgrooves has a width ranging from 0.0025 inch to 0.0030 inch.

9. The iron-type golf club head according to claim 8 wherein the golf club head has a loft angle ranging from 50 degrees to 68 degrees.

10. The iron-type golf club head according to claim 8 wherein each microgroove of the plurality of microgrooves has a U-like cross-sectional shape.

11. The iron-type golf club head according to claim 8 wherein the body is composed of stainless steel, titanium alloy, carpenter steel, or any combination thereof.

12. An iron-type golf club head comprising:

a body having a face; and a first plurality of grooves located on the face, wherein each of the first plurality of grooves has a depth of at least 0.010 inch and each of the first plurality of grooves is spaced at least 0.02 inch from any other of the first plurality of grooves, and a second plurality of grooves located on the face, wherein each of the second plurality of grooves is positioned between and spaced apart from the each of the first set of plurality of grooves and each of the second plurality of grooves is positioned at an angle ranging from 15 degrees to 25 degrees relative to each of the first set of plurality of grooves, wherein each of the second plurality of grooves has a width ranging from 0.0025 inch to 0.0030 inch, wherein each of the second plurality of grooves is spaced from 0.010 inch to 0.015 inch from an adjacent groove of the second plurality of grooves.

13. The iron-type golf club head according to claim 12 wherein the depth of each of the second plurality of grooves is approximately 0.0008 inch.

14. The iron-type golf club head according to claim 12 wherein the golf club head has a loft angle ranging from 50 degrees to 68 degrees.

15. The iron-type golf club head according to claim 12 wherein the body is composed of stainless steel, titanium alloy, carpenter steel, or any combination thereof.

* * * * *